United States Patent [19]

Tanner

[11] Patent Number: 4,999,853

[45] Date of Patent: Mar. 19, 1991

[54] BELT HAVING ADHERING MEANS FOR SIZE ADJUSTMENT

[75] Inventor: Carolyn W. Tanner, Atlanta, Ga.

[73] Assignee: Carolyn Tanner Designs, Inc., Atlanta, Ga.

[21] Appl. No.: 868,349

[22] Filed: May 28, 1986

[51] Int. Cl.[5] ..... A41F 9/02

[52] U.S. Cl. ..... 2/321; 2/DIG. 6

[58] Field of Search ..... 2/321, DIG. 6, 322, 2/94, 331, 300, 311, 338

[56] References Cited

U.S. PATENT DOCUMENTS

| | | | |
|---|---|---|---|
| 2,914,070 | 11/1959 | Kellner | 2/311 |
| 2,924,827 | 2/1960 | Stollman | 2/311 |
| 3,000,384 | 9/1961 | Piers | 2/DIG. 6 |
| 3,136,311 | 6/1964 | Lewis | 2/DIG. 6 |
| 4,273,130 | 6/1981 | Simpson | 2/DIG. 6 |
| 4,472,839 | 9/1984 | Johansen | 2/DIG. 6 |
| 4,509,214 | 4/1985 | Shea | 2/DIG. 6 |

FOREIGN PATENT DOCUMENTS

| | | | |
|---|---|---|---|
| 674275 | 1/1930 | France | 2/321 |

OTHER PUBLICATIONS

Gershman, "Self Adhering Nylon Tapes", Journal of A.M.A., vol. 168, No. 7, p. 980, 10-1958.

*Primary Examiner*—Werner H. Schroeder
*Attorney, Agent, or Firm*—Patrick F. Henry, Sr.

[57] ABSTRACT

A belt is constructed with a decorative front portion of any design and first and second belt portions secured at opposite ends of the belt front for adjustable fastening. One of the ends of the belt portions is provided with a loop through which the other end of a belt portion is inserted and looped upon itself adjustably to bring "Velcro" (trademark) loop means into concealed engagement with barb-like hook members. The "Velcro" is a continuous, co-extensive strip of loop and hook members which is sewed to the inside of one of the end portions and is concealed inside the back of the belt.

9 Claims, 1 Drawing Sheet

BELT HAVING ADHERING MEANS FOR SIZE ADJUSTMENT

A belt having a fixed decorative front portion with opposite first and second portions adjustable by inserting one end of one portion through a loop on the other end of the other portion and adhering an adjustable means such as "Velcro" (trademark) which is attached to the inside of the one portion as a continuous strip rather than two separate surfaces so that the "Velcro" is concealed.

Adjustable belts are quite common and most use a buckle or some similar means at the front of the belt to provide the adjustment. Other belts and similar decorative paraphernalia are adjustable at the back and are quite common for women's wear. Some belts and similar devices are adjustable by reusable adhering means not of the chemical or adhesive tacky sort but rather by "Velcer" (trademark) which comprises small plastic loops over a surface area that may be detachably and removably engaged by small barb-like plastic members, somewhat like thorns, which catch in the loops but are easily pulled therefrom somewhat like removing thorns or briars from a fabric. "Velcro" may be purchased in strips on the open market and attached in place as by gluing or sewing to provide the desired contact surface. U.S. Pat. No. 3,000,384 discloses a "FASTENER TIE" which utilizes "Velcro" (trademark) to encircle a ponytail in an adjustable manner. Similar arrangements are used on headbands or sweatbands for tennis players and other athletes and are adjustably mounted on terrycloth. The usual arrangement is to put the barb-like portion on one end and the loop portion on the other so that the two portions may be adjustably overlapped. This exposes one part of the "Velcro" to the outside and may be unsightly and unattractive. U.S. Pat. No. 3,426,363 discloses a "COMPOSITE LENGTH OF PILE FABRIC SHEET MATERIAL" having "VELCRO" hooking elements and loops which are resepctively positioned on one continuous material and overlapped at the abutting edge. Thus, according to that patent the hooking elements may be inserted through a loop and adjustably secured to the pile or loop fabric. U.S. Pat. No. 4,472,839 discloses a cummerbund wherein the hooking elements of a "Velcro" arrangement are contained on one end and the pile fabric is inside the belt on the other end and it is necessary to utilize a loop to perform the proper engagement in alignment between the ends and the adjustable engagement of the "Velcro". The present arrangement provides a simpler way of making an adjustable belt so that the complete "Velcro" strip of both pile or looped surface and hooking elements may be sewn, glued, or otherwise attached to the inside of only one portion of the belt and then the end of the other portion is looped upon itself through a simple buckle to provide ready attachment in place and adjustment on the wearer with the "Velcro" concealed from view.

Briefly described, the present belt comprises a decorative front portion, which may be of any design and construction such as metallic ropes, leather segments and the like, having a respective first and second belt portion attached thereto at opposite sides extending to provide respective first and second terminal ends. An adhering means, such as the "Velcro" strip mentioned previously, is made in one continuous strip, such as disclosed in U.S. Pat. No. 3,426,363, or by stitching a length of "Velcro" pile or looped fabric to a length of hooking elements and then installed on the inside of the back of one of the first or second portions by stitching or gluing same. A buckle loop is attached to the terminal end of the other first or second portion. Thus, the wearer simply inserts the "Velcro" portion of the belt upon itself through the buckle loop and then adheres the concealed terminal end in place inside the belt.

A primary object of this invention is to provide a simple yet attractive construction in a belt with easy and attractive adjustable means at the back of the belt for adhering the belt upon itself as by the use of "Velcro" or other adhering means.

Another object of this invention resides in the simplicity of construction whereby a strip of "Velcro" having a portion of the length of fabric or loops attached to a portion of the length of hooking elements for installation on the belt whereby both the parts of the "Velcro" are on the same side and together.

Another advantage of this device resides in the construction whereby the belt is adjusted by looping the belt upon itself thereby placing the end of the belt in a concealed fashion inside the back.

Other and further objects and advantages of this invention will become apparent upon reading the following description of a preferred embodiment taken in conjunction with the accompanying drawings, in which.

DESCRIPTION OF A PREFERRED EMBODIMENT

Figure 1:
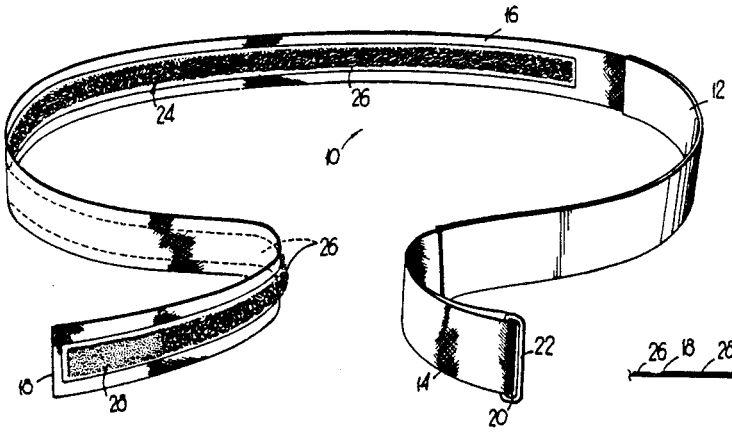
FIG. 1 is a perspective view of the present belt in open condition showing continuous "Velcro" adhering means on the inside of one portion of the belt.
Figure 3:
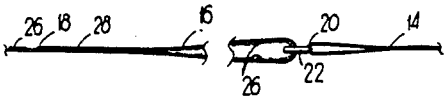
FIG. 3 is a plan view of the edge of the belt of FIG. 1 with parts broken away and showing the "Velcro" engaged and the portion of the belt looped through the buckle.
Figure 2:
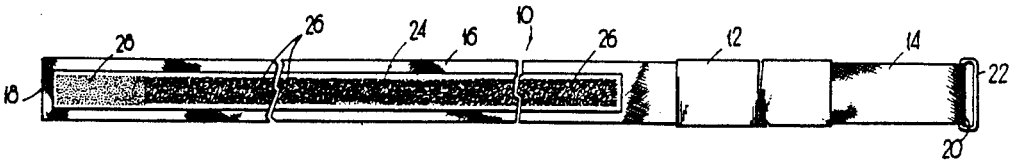
FIG. 2 is a plan view of the portion of the belt in FIG. 1 having the "Velcro" thereon.

The belt 10, which also may be any other decorative item encircled about a wearer's body, comprises a front decorative portion 12 of any design or construction utilizing metal, leather, plastic, fabric or otherwise in various shapes and forms as may be conceived by the creative endeavors of the belt designer. A first portion 14 and a second portion 16 extend in a longitudinal fashion from the front portion 12 and are attached thereto by stitching, fastening or otherwise. First and second portions 14, 16 may be made from fabric which is doubled upon itself to form a flat tube having respective terminal ends 18, 20. A simple buckle loop 22 is attached to a looped, double-ply terminal end 20.

A continuous strip of "Velcro" (trademark) 24 comprises a longitudinal length of pile or looped "Velcro" material 26 abutting and attached to the hooking or barb-like element portion 28 by stitching same together or by utilizing the procedure set forth in U.S. Pat. No. 3,426,363 which involves skiving or shaving the hooking elements down to the surface of the base material and so forth and then joining the portions by an adhesive. Alternatively, a section of "Velcro" 26 can be abutted with the end of a section of "Velcro" 28 and stitched in place. Then the entire strip 24 can be stitched to the inside of the first portion of the belt. The hook portion 28 is close to end 18 and is coextensive with the strip 24 and end to end with loop portion 26 whereby there is an infinite number of positions of adjustment.

While I have shown and described a particular embodiment of this invention together with a suggested mode of operation this is by way of illustration only since various alternations, changes deviations and departures may be made in the embodiment shown without avoiding the scope of this invention as defined only by a proper interpretation of the appended claims.

What is claimed is:

1. In a decorative belt for positioning about the waist of the body of a wearer:

a decorative front portion having opposed first and second portions extending therefrom, said first portion having a first end and said second portion having a second end, said belt having an inside and an outside with the decorative front portion on the outside, said first and second ends being closable to form the back of said belt, a loop member on said first end, means for adhering a portion of the inside of said second end of said belt to another part of the inside of said belt whereby said second end is inserted through said loop and looped upon itself to engage selectively and adjustably said means for adhering inside the belt.

2. The belt claimed in claim 1 wherein said adhering means comprises continuous strip area selectively engageable upon itself.

3. The belt claimed in claim 1 wherein said means for adhering comprises hook and pile fabric to provide the adjustment of the belt on the wearer.

4. The belt claimed in claim 1 wherein said adhering means is a continuous strip of material having both a continuous pile fabric and continuous hooking members arranged end-to-end on said strip and in continuous end-to-end relationship thereon.

5. The belt in claim 4, said strip being assembled prior to attachment to the inside of the belt and said strip being attached to the inside of said belt.

6. The belt in claim 5 wherein said pile fabric is located closer to the second end of said second portion and is shorter in length than said hooking members.

7. The belt in claim 4 wherein said strip is sewn together and to the inside of said belt.

8. The device in claim 3 wherein said pile fabric and hooking members are attached together end-to-end to a strip and in continuous, coextensive relationship on said strip inside of said belt.

9. The belt in claim 1: said means for adhering comprising a continuous strip area of pile and an area of hooking members coextensive with said strip and end-to-end for selective engagement thereon to provide the adjustment of the belt on the wearer, said continuous strip having both the pile and the hooking members positioned end-to-end thereon prior to attachment to the inside of the belt, said strip being attached to the inside of said belt, and one of the area of pile and area of hooking members being shorter in length than the other and being located near the terminal end of the respective portions.

* * * * *